US011730981B2

(12) United States Patent
Gallagher

(10) Patent No.: US 11,730,981 B2
(45) **Date of Patent: *Aug. 22, 2023**

(54) PORTABLE CONTAINMENT DEVICE

(71) Applicant: Timothy S. Gallagher, Huron, OH (US)

(72) Inventor: Timothy S. Gallagher, Huron, OH (US)

( * ) Notice: Subject to any disclaimer, the term of this patent is extended or adjusted under 35 U.S.C. 154(b) by 515 days.

This patent is subject to a terminal disclaimer.

(21) Appl. No.: 16/813,078

(22) Filed: Mar. 9, 2020

(65) Prior Publication Data

US 2020/0238109 A1 Jul. 30, 2020

Related U.S. Application Data

(60) Provisional application No. 62/869,196, filed on Jul. 1, 2019.

(51) Int. Cl.

| | |
|---|---|
| ***A62B 7/10*** | (2006.01) |
| ***A62B 23/02*** | (2006.01) |
| ***A62B 19/00*** | (2006.01) |
| ***A41D 13/11*** | (2006.01) |
| ***A62B 23/00*** | (2006.01) |
| ***A62B 25/00*** | (2006.01) |
| ***A62B 18/02*** | (2006.01) |

(52) U.S. Cl.

CPC ..... *A62B 7/10* (2013.01); *A41D 13/11* (2013.01); *A62B 19/00* (2013.01); *A62B 23/00* (2013.01); *A62B 23/02* (2013.01); *A41D 13/1192* (2013.01); *A62B 18/025* (2013.01); *A62B 25/00* (2013.01)

(58) Field of Classification Search

CPC ..... A62B 7/10; A62B 19/00; A62B 19/02; A62B 23/00; A62B 23/02; A62B 23/025; A62B 18/025; A62B 18/00; A62B 18/02; A62B 25/00; A41D 13/11; A41D 13/1107; A41D 13/113; A41D 13/1138; A41D 13/1153; A41D 13/1192; A61J 19/00; A61J 19/06; A61J 19/02; A41B 15/00

See application file for complete search history.

(56) References Cited

U.S. PATENT DOCUMENTS

| | | | |
|---|---|---|---|
| 1,491,674 | A | 4/1924 | Coletti |
| 2,269,461 | A | 1/1942 | Lehmberg |
| 3,548,823 | A | 12/1970 | Bogacik |
| 3,735,571 | A | 5/1973 | Pampuch |

(Continued)

FOREIGN PATENT DOCUMENTS

WO WO-2005087320 A1 * 9/2005 ..... A41D 1/04

OTHER PUBLICATIONS

Office Action from U.S. Appl. No. 16/923,745 dated Sep. 4, 2020.

(Continued)

*Primary Examiner* — Joseph D. Boecker
*Assistant Examiner* — Brian T Khong
(74) *Attorney, Agent, or Firm* — Calfee, Halter & Griswold LLP

(57) ABSTRACT

Portable containment device having a chamber which further includes a first end, a second end, and a vertical wall, wherein a filter is arranged at the second end to entrap airborne particles emitted into an opening formed at the first end of the portable containment device.

20 Claims, 12 Drawing Sheets

(56) References Cited

U.S. PATENT DOCUMENTS

| | | | | |
|---|---|---|---|---|
| 4,562,837 | A * | 1/1986 | Schlobohm | A62B 23/02 128/206.17 |
| 4,583,535 | A * | 4/1986 | Saffo | A62B 17/04 2/205 |
| 4,848,366 | A | 7/1989 | Aita | |
| 5,016,628 | A | 5/1991 | Lambert | |
| 5,350,513 | A | 9/1994 | Markowitz | |
| 5,367,706 | A * | 11/1994 | Davidson | A42B 1/201 2/202 |
| 5,920,909 | A * | 7/1999 | Ellsworth | A41D 23/00 132/273 |
| 6,532,598 | B1 * | 3/2003 | Cardarelli | A41D 13/11 2/173 |
| 6,543,450 | B1 * | 4/2003 | Flynn | A62B 23/025 128/206.25 |
| 9,723,880 | B1 * | 8/2017 | Macey, Jr. | A41D 13/11 |
| 2005/0045185 | A1 * | 3/2005 | Takowsky | A41D 13/11 128/858 |
| 2006/0040333 | A1 | 2/2006 | Zocchi | |
| 2007/0095348 | A1 | 5/2007 | Fisher et al. | |
| 2009/0101151 | A1 | 4/2009 | Russell | |
| 2009/0270831 | A1 * | 10/2009 | Mazzone | A61J 19/00 604/404 |
| 2010/0018532 | A1 * | 1/2010 | Moravec | A41D 13/1192 128/205.29 |
| 2010/0229871 | A1 * | 9/2010 | Marx | A62B 23/025 128/206.19 |
| 2011/0062051 | A1 * | 3/2011 | Miller | B65D 75/566 206/570 |
| 2011/0083259 | A1 | 4/2011 | Wright | |
| 2011/0119820 | A1 * | 5/2011 | Whittington | A61J 19/00 4/285 |
| 2014/0007888 | A1 | 1/2014 | Sanchez Talero | |
| 2014/0182592 | A1 * | 7/2014 | Aharoni | A61M 16/106 128/205.25 |
| 2014/0237695 | A1 | 8/2014 | Al Malki | |
| 2014/0251349 | A1 * | 9/2014 | Delatorre | A61J 19/02 128/863 |
| 2015/0013681 | A1 * | 1/2015 | Stockhamer | A41B 15/00 96/417 |
| 2017/0290719 | A1 | 10/2017 | Epstein | |
| 2018/0078797 | A1 * | 3/2018 | Bergman | A62B 18/084 |
| 2020/0230342 | A1 * | 7/2020 | Cho | A62B 7/10 |

OTHER PUBLICATIONS

Office Action from U.S. Appl. No. 16/923,745 dated Jan. 21, 2021.
Notice of Allowance dated May 17, 2021 in related U.S. Appl. No. 16/923,745, pp. 1-27.

* cited by examiner

PORTABLE CONTAINMENT DEVICE

CROSS-REFERENCE TO RELATED APPLICATIONS

The present application claims priority to, and any other benefit of, U.S. Prov'l Pat. Appl'n Ser. No. 62/869,196, filed Jul. 1, 2019, the entire disclosure of which is incorporated herein by reference as though recited herein in its entirety.

TECHNICAL FIELD

This pertains to an apparatus and method for isolating airborne particles, and more particularly, to a portable containment device having an expandable chamber and a filter arranged therein that is configured to entrap airborne particles (e.g., respiratory droplets, spittle, and pathogens) emitted into the chamber from a human mouth.

BACKGROUND

Disposable face masks are known in the art. An exemplary surgical type face mask includes a pair of ear loops that are configured to secure the face mask to a human face. Such masks can block spittle (saliva ejected from the mouth), respiratory particles, and other particles ejected during coughing. In some countries, such as Japan and China, one commonly sees people wearing such surgical masks in public (outside a medical or dental context); however, doing so is uncommon in the United States.

Applicant has appreciated the need for a portable and cost-effective means of preventing airborne diseases from spreading, such as when a person having an airborne disease is situated in a confined environment with others susceptible of contracting the airborne disease without the stigma of wearing a surgical mask throughout the day in public.

SUMMARY

In some exemplary embodiments, an exemplary portable containment device comprises an expandable chamber having a vertical wall, a first end, and a second end, wherein an opening is formed at the first end, and a filter is arranged at the second end, the filter being operable to entrap airborne particles entering the opening formed at the first end.

In some exemplary embodiments, an exemplary method of preventing the transmission of airborne particles includes the steps of: providing a resealable container and a portable containment device having an expandable chamber; wherein the chamber includes a vertical wall, a first end, and a second end; and wherein the first end includes an opening that is configured to receive at least a human mouth and a chin; extending the second end away from the first end such that the portable containment device is at least partially extended and in a configuration in which it is too large to be storable in the container; arranging at least the mouth and the chin in the opening formed in the first end such that at least the mouth and the chin are fully confined by a periphery of the opening; emitting airborne particles into the portable containment device; and compressing the second end towards the first end such that the portable containment device returns to a configuration in which it is storable in the container.

In additional exemplary embodiments, an exemplary kit comprises a portable containment device provided inside a container and instructions provided on a sheet inside or printed or affixed on the container; wherein the instructions instruct a user to: remove the portable containment device from the container; extend the portable containment device such that it is at least partially extended; arrange at least a mouth and a chin in the opening formed in the portable containment device such that the mouth and the chin are confined by a periphery of the opening; emit airborne particles into the portable containment device as needed; and compress the portable containment device such that it returns to a configuration in which it is storable in the container; place the portable containment device into the container after each use; reseal the container; and dispose of the container.

In yet another exemplary embodiment, an exemplary portable containment device comprises a tubular, pliable sleeve; wherein the sleeve is configured to be expandable when operating the portable containment device, and collapsible when storing the portable containment device; wherein the sleeve includes an upper end, a circumferential side wall, a lower wall, and an opening formed at the upper end; wherein the opening is defined by a plastic ring that is disposed in the upper end and secured via stitching; wherein the sleeve further comprises microporous, polypropylene-based material; wherein a disk-shaped particulate filter is arranged in a lower-most portion of the sleeve, the filter being secured to a periphery of the circumferential side wall and the lower wall via stitching; wherein the filter is operable to entrap airborne particles entering the portable containment device; and wherein the particulate filter comprises a filter having a NIOSH approved P95 or N95 rating.

DETAILED DESCRIPTION

This Detailed Description merely describes exemplary embodiments of the invention and is not intended to limit the scope of the claims in any way. Indeed, the invention as claimed is broader than and unlimited by the preferred embodiments, and the terms used in the claims have their full ordinary meaning.

Figure 1:
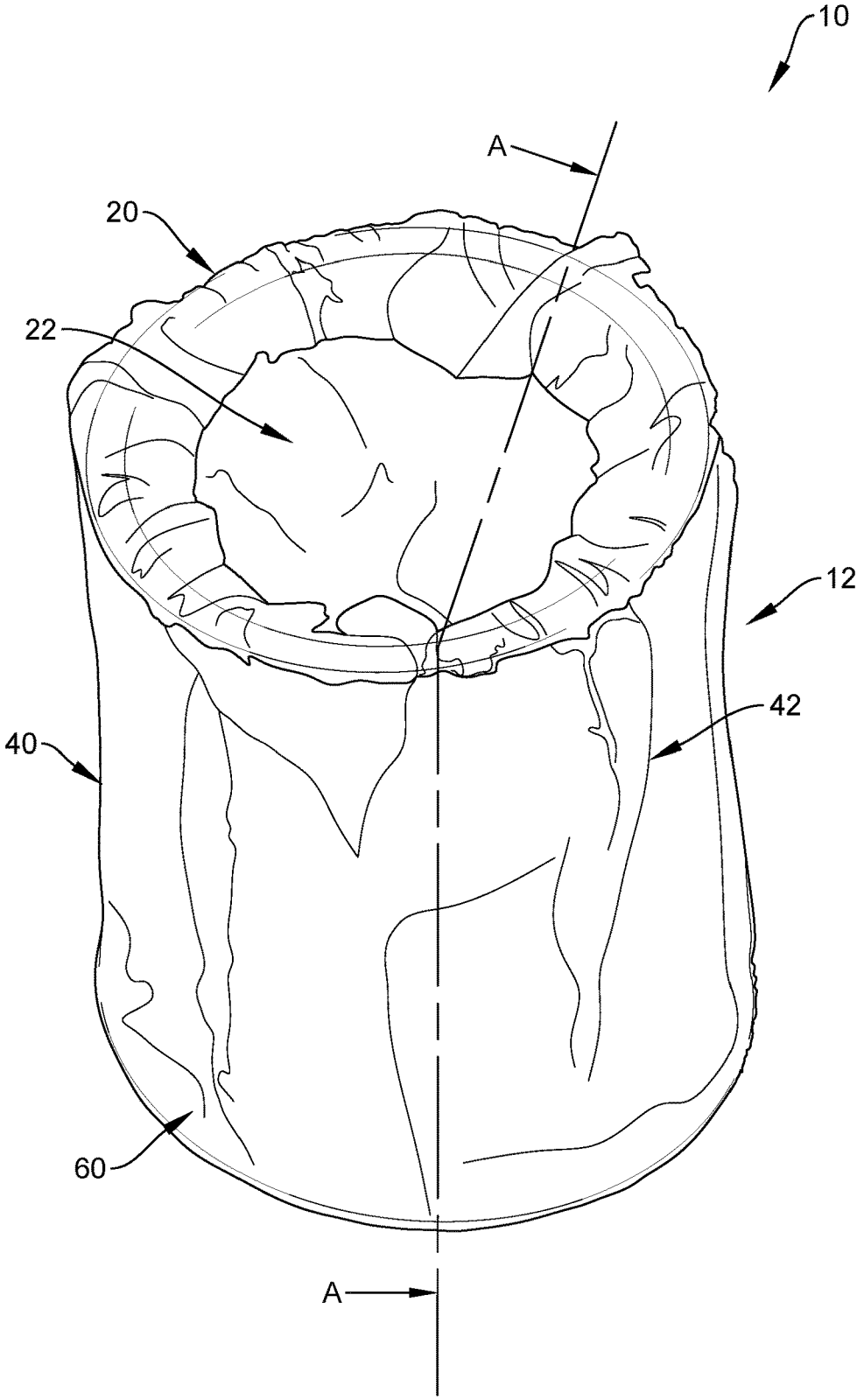
FIG. 1 is a schematic representation of an exemplary portable containment device in an extended position.
Figure 6:
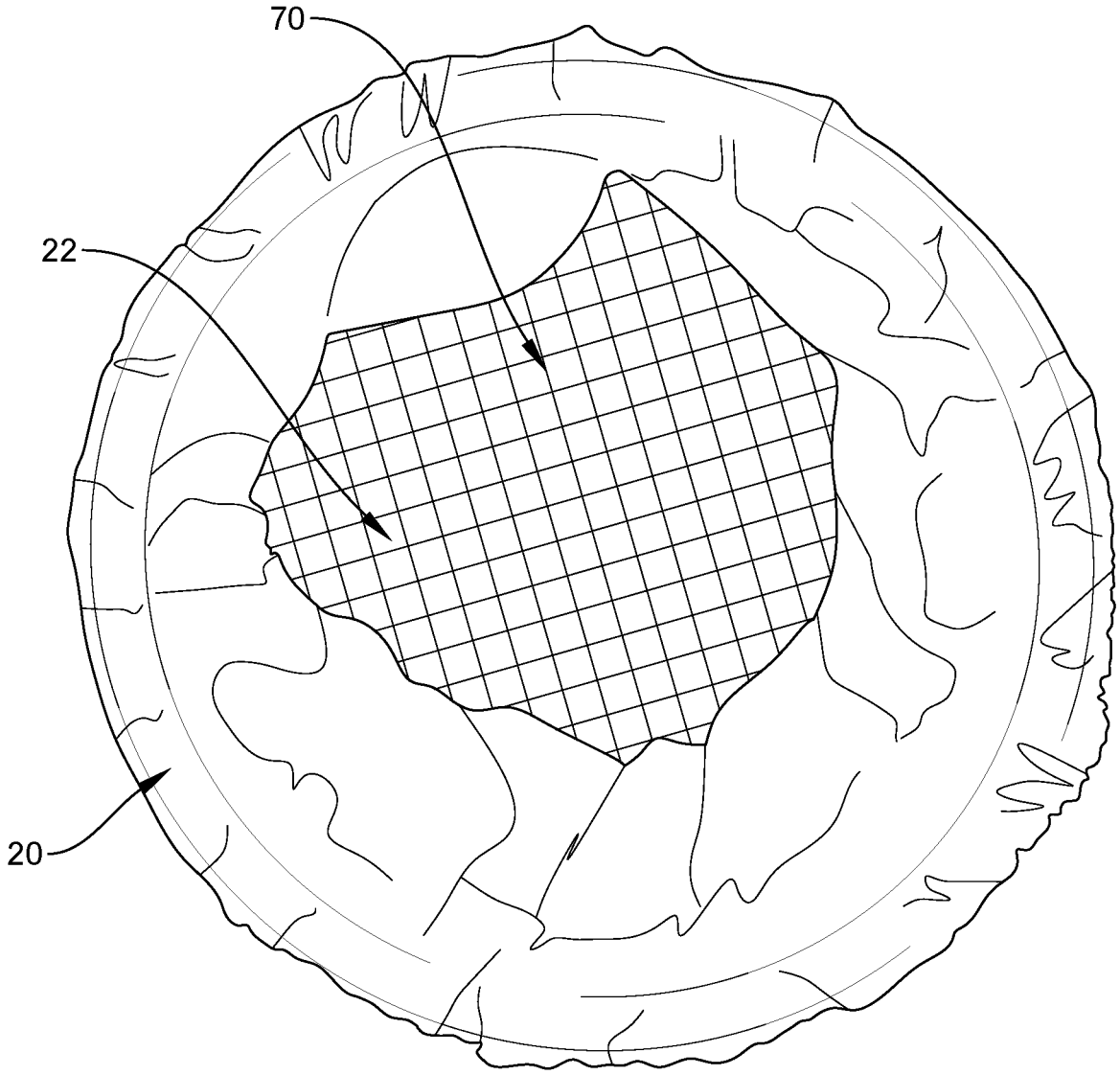
FIG. 6 is a top plan view of an exemplary portable containment device.

The present application is directed towards a portable containment device having a chamber and a filter arranged therein that is configured to entrap airborne particles emitted into the chamber of the device (e.g., respiratory droplets, spittle, and/or pathogens emitted by a user coughing into the portable containment device). FIG. 1 shows an exemplary portable containment device 10 having a chamber 12 that includes a first end 20, a vertical wall 40, and a second end 60. In some exemplary embodiments, the second end 60 is configured to accommodate a filter (e.g., 70 in FIG. 6) that is arranged thereon. In some exemplary embodiments, the chamber vertical wall 40 is configured to be selectively expandable when operating the portable containment device 10, and selectively compressible when storing the portable containment device 10.

In some exemplary embodiments the portable containment device is provided in a container (e.g., 90 in FIG. 15) that is configured to store the portable containment device, respectively, when the portable containment device is in a configuration in which it is storable in the container. In further exemplary embodiments, the container is configured to serve multiple purposes (e.g., point of purchase packaging, temporary storage, product disposal container).

Figure 2:
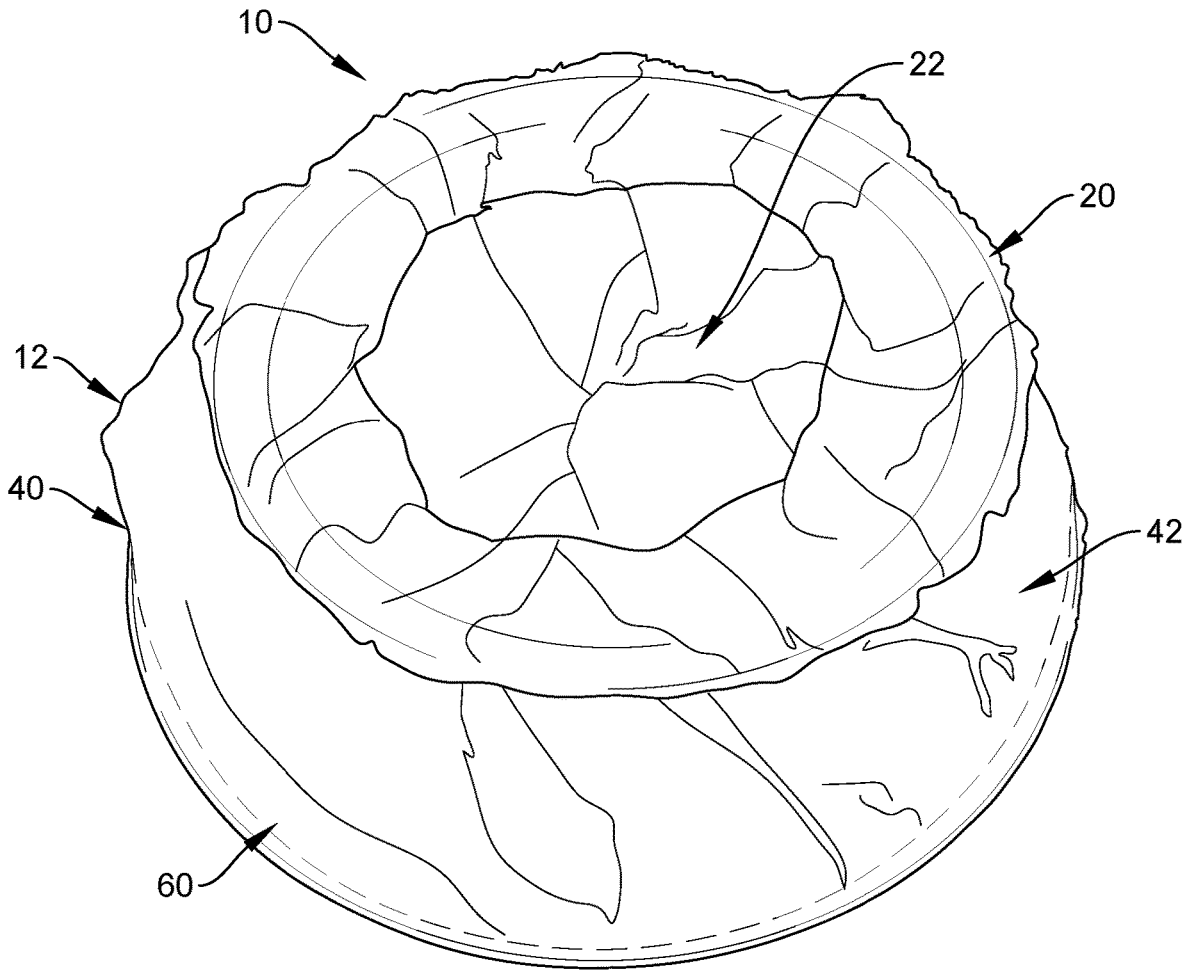
FIG. 2 is a schematic representation of an exemplary portable containment device in a collapsed position (smaller, more compact shape).

Referring now to FIG. 1, an exemplary portable containment device 10 having an exemplary chamber 12 according to the present application is shown. Portable containment device 10 includes a chamber 12 having a first end 20, a vertical wall 40, a second end 60, and a filter 70 (FIG. 6) that is arranged therein. In some exemplary embodiments, the portable containment device 10 is configured to be used for entrapping airborne particles emitted into the chamber 12 (e.g., by coughing or sneezing). In this respect, the portable containment device 10 is configured to be used by persons having diseases capable of airborne transmission (e.g., influenza, tuberculosis, etc.). It is expected that use of the portable containment devices described herein will trap airborne particles ejected during coughing and will, thus, prevent (or at least help prevent) the transmission of airborne diseases. In some exemplary embodiments, the portable containment device 10 is particularly suitable for individuals such as passengers, workers, or students who are situated in confined public spaces. In some exemplary embodiments, the portable containment device 10 is configured to be easily stowed away by collapsing or compressing the vertical wall 40 as shown in the exemplary embodiment of FIG. 2.

Figure 16:
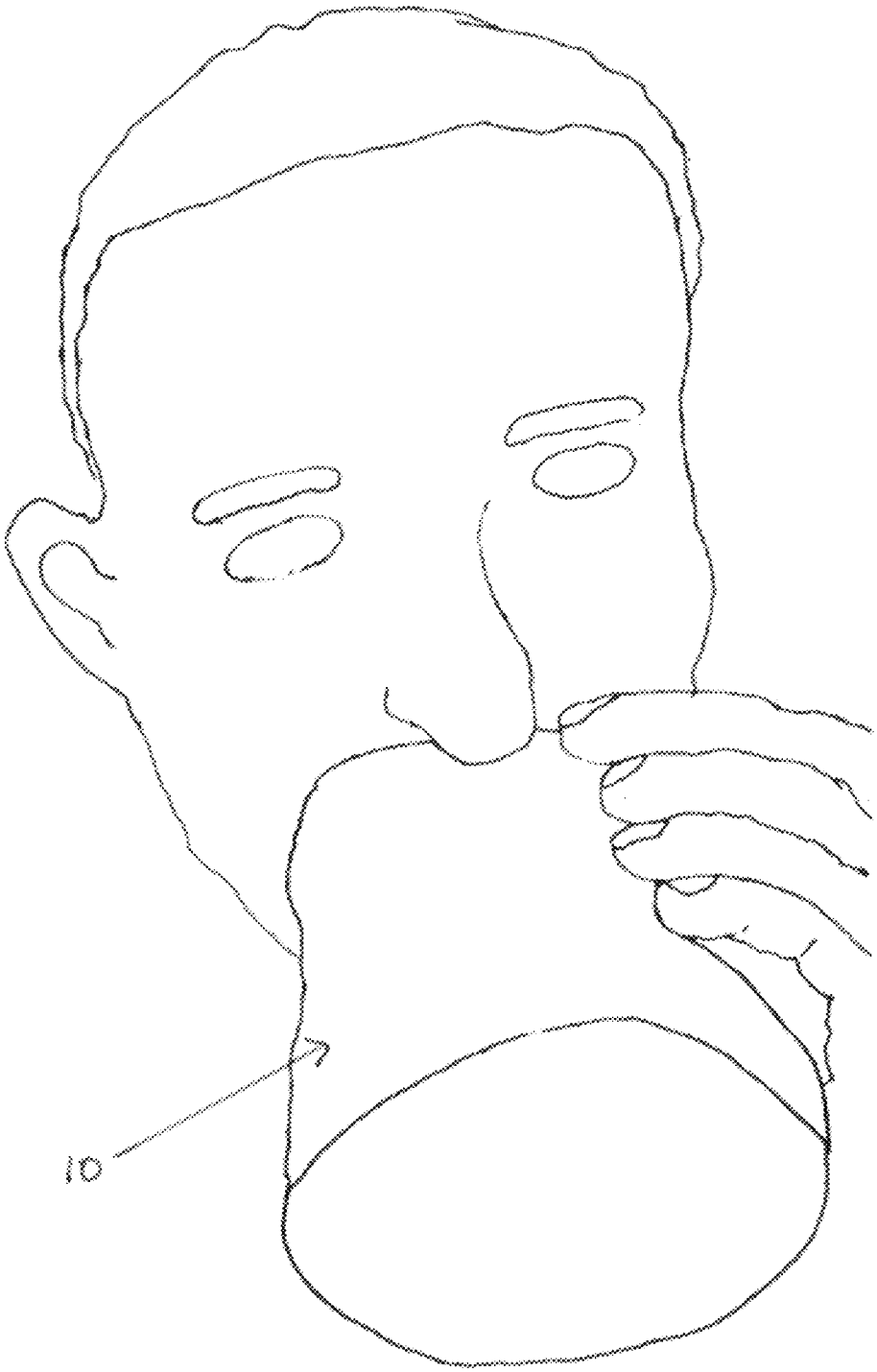
FIG. 16 is a schematic representation of a user operating an exemplary portable containment device.

Referring back to FIG. 1, the first end 20 of an exemplary portable containment device 10 is shaped and configured to define an opening 22 that is devised to receive at least a human mouth (FIG. 16). In other exemplary embodiments, the opening 22 is formed to confine a mouth and at least a chin by a periphery of the opening 22. However, still other exemplary embodiments of an opening 22 are also contemplated (such as, an opening that is shaped and configured to confine nasal passages, the mouth, and the chin, etc., e.g., mouth, tip of the nose (or entire nose), and chin). In further exemplary embodiments, the opening 22 can embody a separate component (not shown) that is removably attached to a proximal end of the vertical wall 40 via known attachment means (e.g., via clips, clasps, fasteners, hook and loop structure, etc.).

Figure 7:
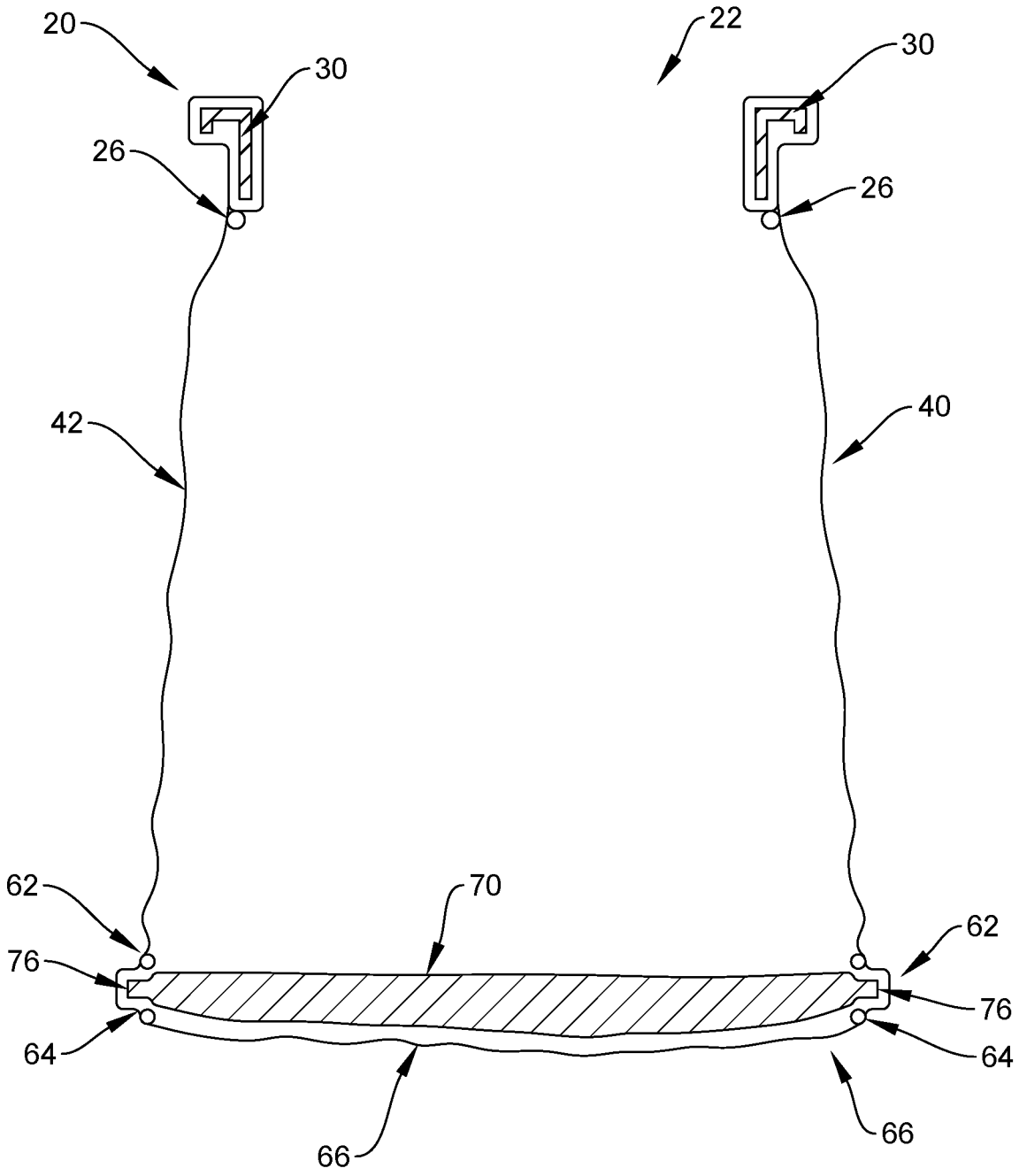
FIG. 7 is a sectional view of an exemplary portable containment device taken along line A-A of FIG. 1.

In some exemplary embodiments, the opening 22 can be formed by disposing a ring 30 (FIGS. 7-8) in a proximal end of the vertical wall 40, particularly in such embodiments where the vertical wall 40 comprises a pliable sleeve 42 (FIG. 1). Referring to the exemplary embodiment of FIG. 7 (sectional view taken along line A-A of FIG. 1), the proximal end of the sleeve 42 is configured to wrap around the ring 30 such that the ring 30 is enclosed by the sleeve 42. In this embodiment, the proximal end of the sleeve 42 is then attached to an adjacent portion of the sleeve 42 via an attachment means 26 (e.g., adhesive glue, fusion, stitching, etc.) such that the ring 30 is secured in place.

Figure 8:
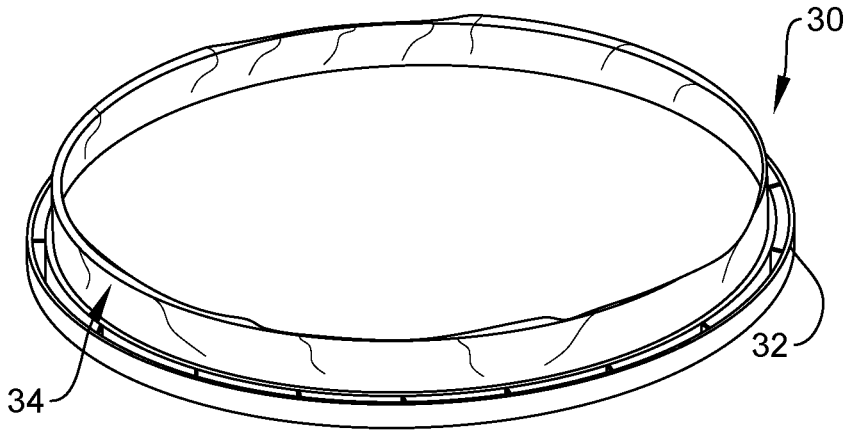
FIG. 8 shows an exemplary ring that is utilized to create an opening of an exemplary portable containment device.
Figure 9:
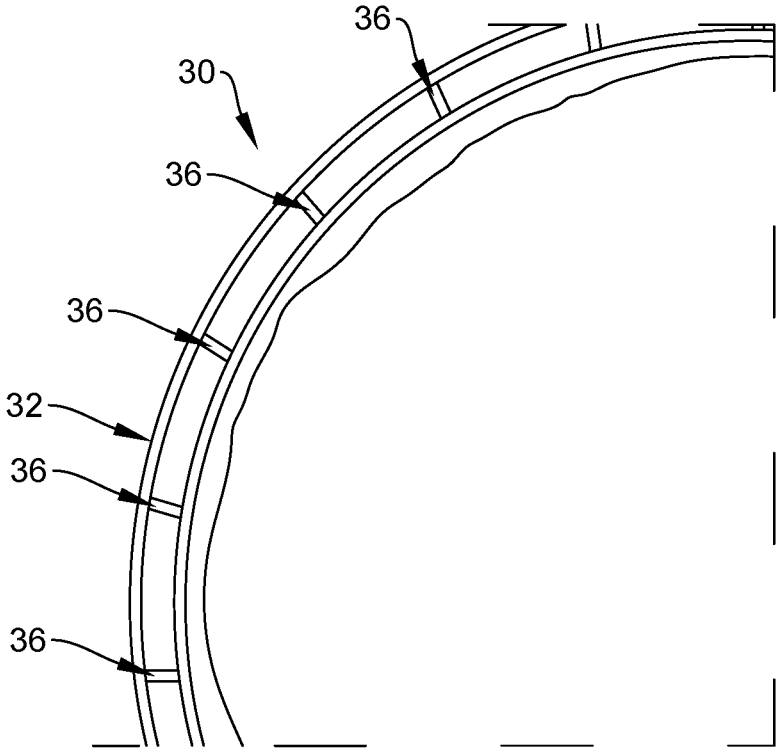
FIG. 9 is a top, close-up view of a portion of the exemplary ring according to FIG. 8.

Referring to FIG. 8, an exemplary ring 30 can be formed to include a side wall 34 and a heel 32 that is attached thereto. In some exemplary embodiments, the exemplary ring 30 can be produced by plastic injection molding, blow molding, machining, or any other suitable manufacturing process. In prototypes, the ring 30 was formed by cutting the top off of an eight-ounce plastic measuring cup (e.g., circumferential upper lip). With reference to FIG. 9, a plurality of reinforcing ribs 36 can be integrally formed to the heel 32 to increase the structural integrity of the ring 30. However, it also contemplated that the ring 30 can embody other shapes and configurations (e.g., circular, square, hollow cross section, solid cross section, etc., e.g., round at the bottom to accommodate a human chin and triangular at the top to accommodate the bridge of a human nose). In yet other exemplary embodiments (FIG. 10), the opening 22 can be formed by winding or curling a proximal end of the pliable sleeve 42 into a formed ball 27, and then securing the formed ball 27 to an adjacent portion of the sleeve 42 via an attachment means 26 as discussed above. In exemplary embodiments, the ring (however formed) and the sleeve 42 will have shapes, configurations, and materials that cooperate with each other to permit the first end 20 of the portable containment device 10 to provide a reasonable degree of sealing around (a) the mouth, (b) the mouth and chin, (c) the mouth, chin, and nostrils, etc. so that the vast majority of particles ejected during a cough will enter the chamber 12 when the portable containment device 10 is manually held in place.

Figure 3:
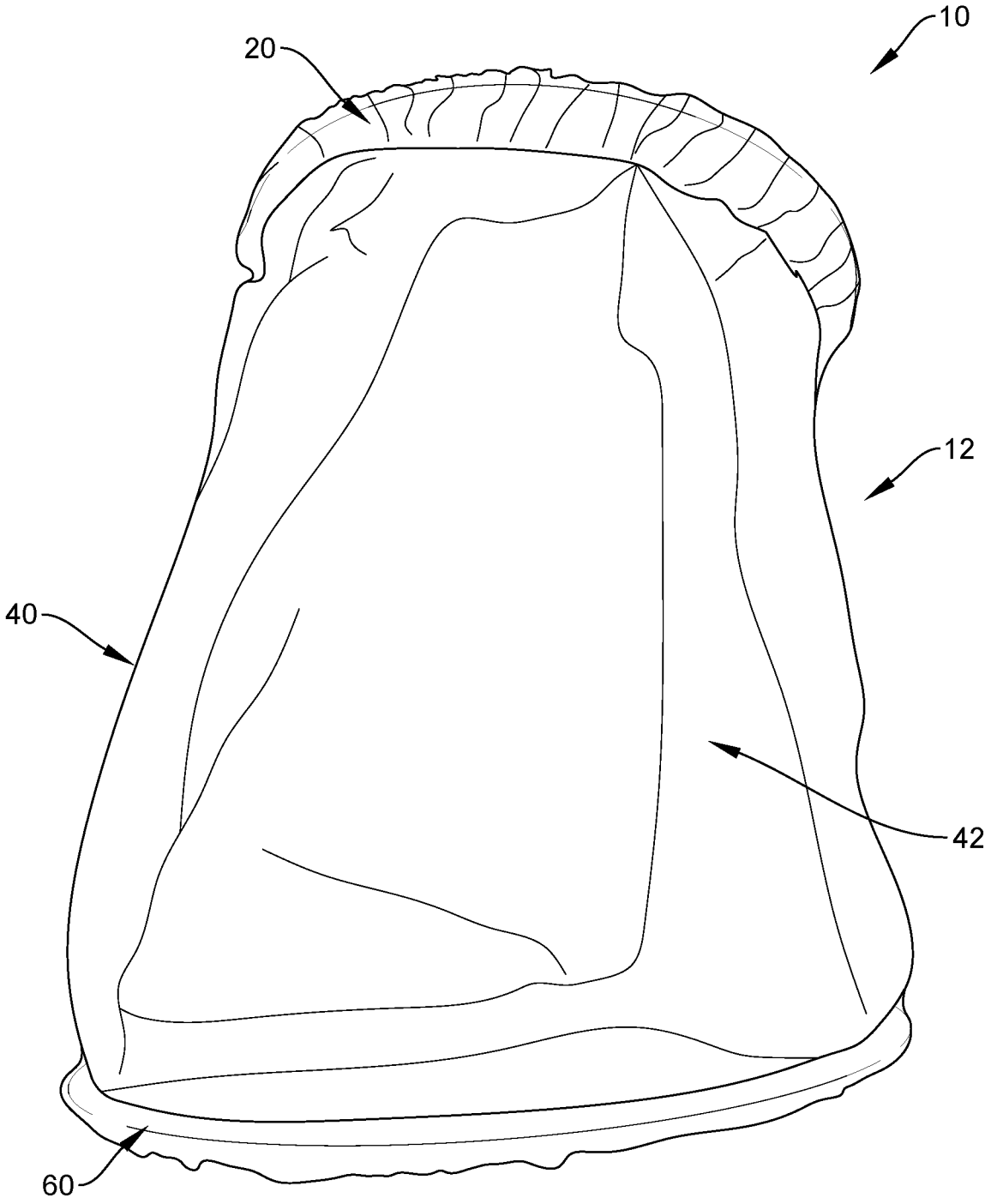
FIG. 3 is a side view of an exemplary portable containment device in an extended position.
Figure 4:
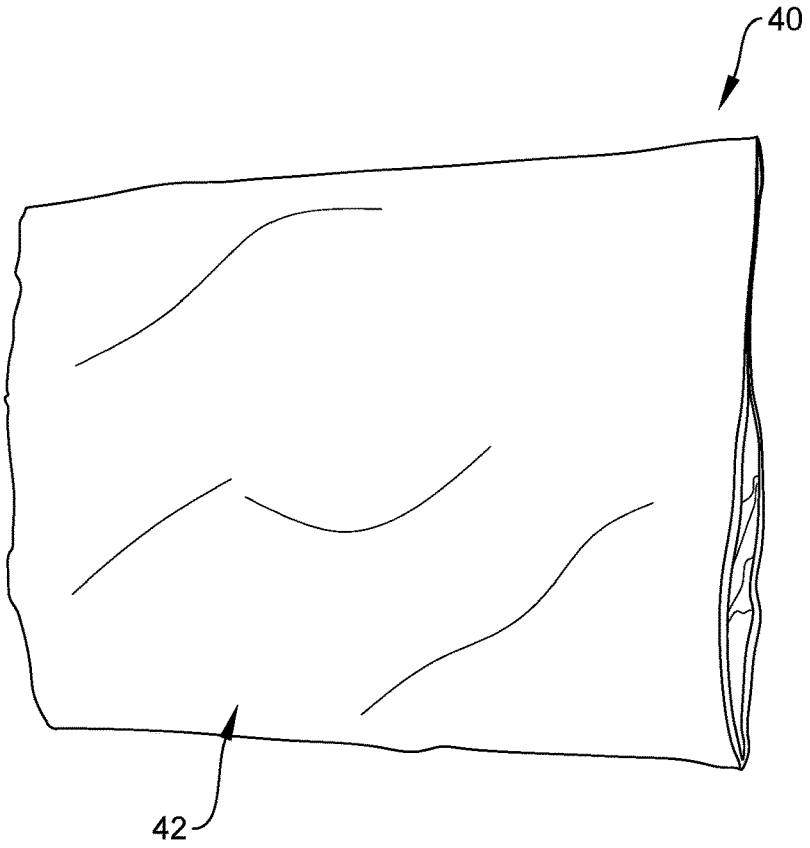
FIG. 4 shows an exemplary chamber sleeve for an exemplary portable containment device.
Figure 5:
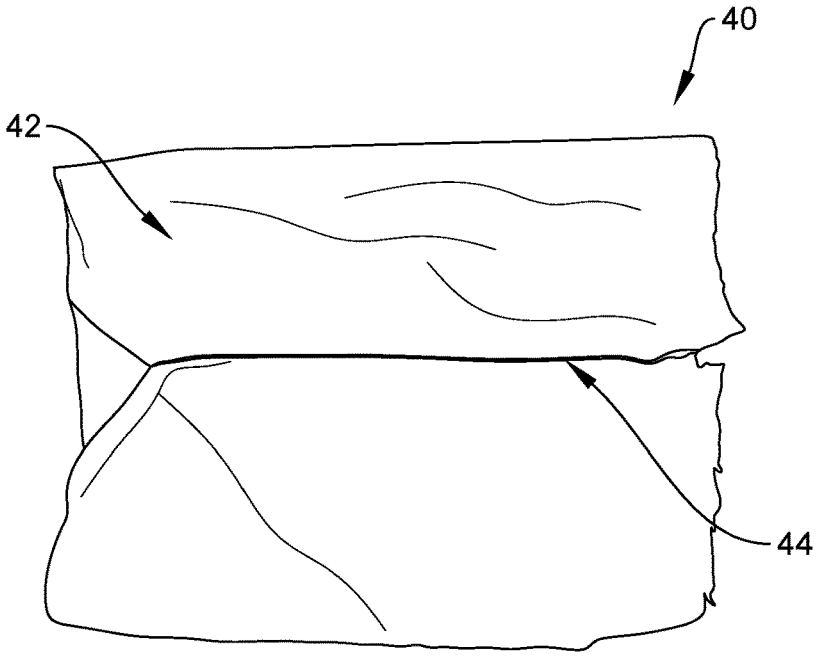
FIG. 5 shows an exemplary attachment means for an exemplary chamber sleeve.

With reference to FIGS. 3-5, an exemplary embodiment of a chamber vertical wall 40 is shown. Referring to FIG. 4, and as discussed above, in exemplary embodiments, the vertical wall 40 is made from a pliable sleeve 42. In some exemplary embodiments, the pliable sleeve 42 is comprised of disposable, high density polyethylene that is devised to prevent airborne particles from exiting the chamber 12 of the portable containment device 10. In other exemplary embodiments, the pliable sleeve 42 can be formed from microporous, polypropylene based fabric-type material. Yet, in other exemplary embodiments, the wall 40 is made from other materials, such as paper, coated paper, thin polymers, etc. In further exemplary embodiments, the pliable sleeve 42 can comprise a tubular structure that is formed seamlessly. In additional exemplary embodiments, the sleeve 42 can be formed by folding a rectangular-shaped sheet of material such that a proximal and distal end of the sheet is then secured together via an attachment means 44 (e.g., FIG. 5—via stitching, adhesives, fusion, heat welding, other heating, ultrasonic welding, chemical (e.g., solvent-based) welding, snaps, staples, hook and loop, etc.). In prototypes, the wall 40 was formed by cutting a Dupont® branded Tyvek 400 suit comprised of 100% high density polyethylene.

In some exemplary embodiments, the pliable characteristics of the sleeve 42 permit the chamber 12 to be selectively expandable when needing to operate the portable containment device 10, or selectively compressible when the portable containment device 10 is to be stowed away. For example, the first end 20 of the chamber 12 can be pulled away from the second end 60 to expand the chamber 12. Conversely, the first end 20 can be compressed towards the second end 60 to collapse the chamber 12 to a configuration making it suitable for storage in a container 90, as described in detail below. Yet, other configurations of a chamber vertical wall 40 are also contemplated. For example, the vertical wall 40 can comprise an accordion-like structure (not shown) that is configured to be expandable by pulling a first end 20 of the chamber 12 away from the second end 60, or collapsible by compressing the first end 20 towards the second end 60 such that accordion-shaped ridges of the vertical wall 40 are nested upon each other. In some exemplary embodiments, the portable containment device 10 is configured to be quickly made available for use by simply inserting a hand portion (e.g., thumb, index finger, and web therebetween) between the first and second ends 20, 60 while the portable containment device 10 is in the configuration of FIG. 2, bringing the portable containment device 10 up to the mouth with the action of the hand (and perhaps gravity), and expanding the chamber a little, i.e., expanding the chamber enough to make holding the device to the mouth and coughing into the device easy. To the extent the chamber 12 is not fully expanded prior to bringing the first end 20 up to the mouth, in some exemplary embodiments, coughing provides sufficient force to finish expanding the portable containment device 10 into the fully expanded configuration of FIG. 1.

Figure 10:
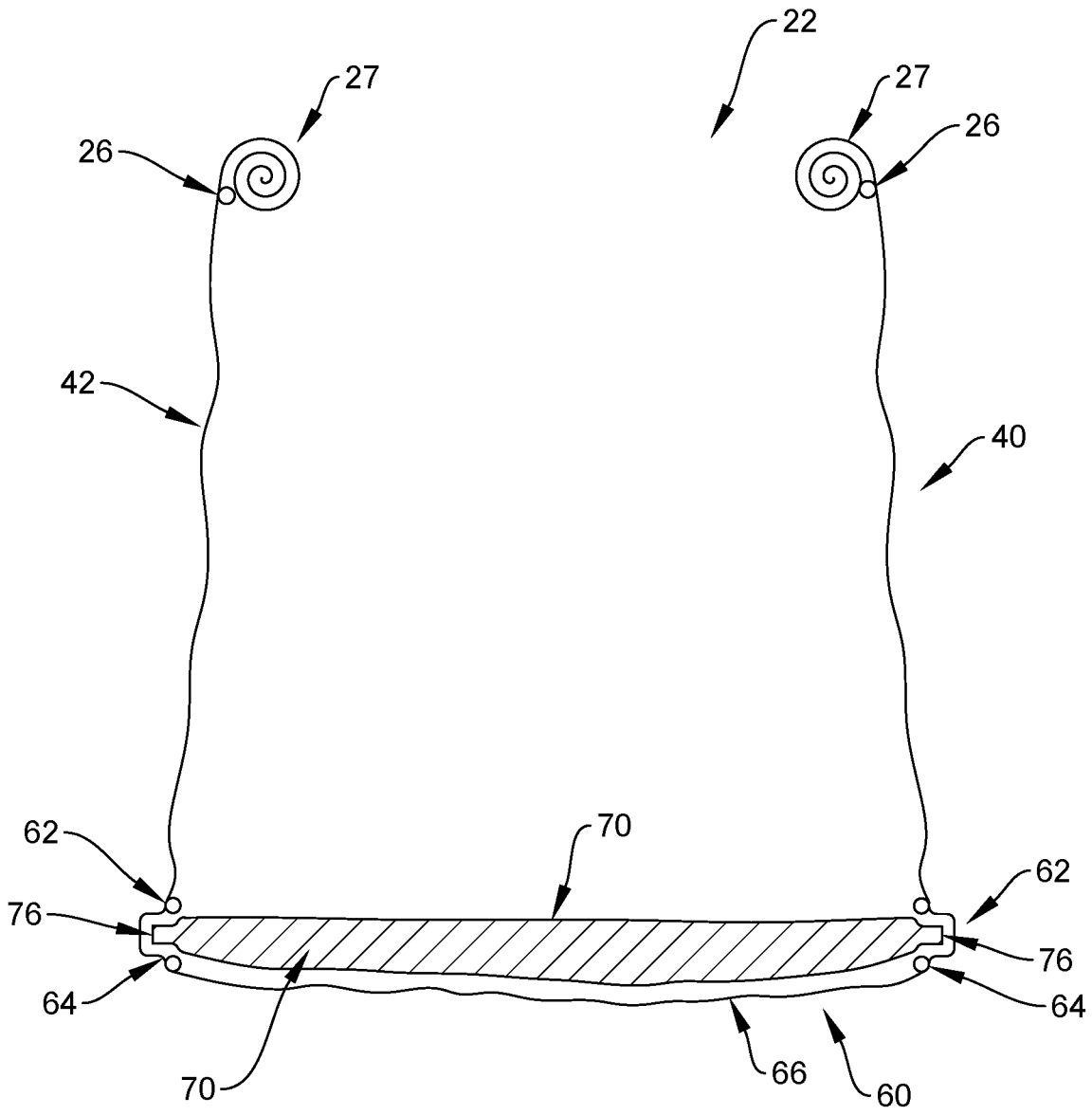
FIG. 10 is a sectional view of another exemplary portable containment device taken along line A-A of FIG. 1.
Figure 11:
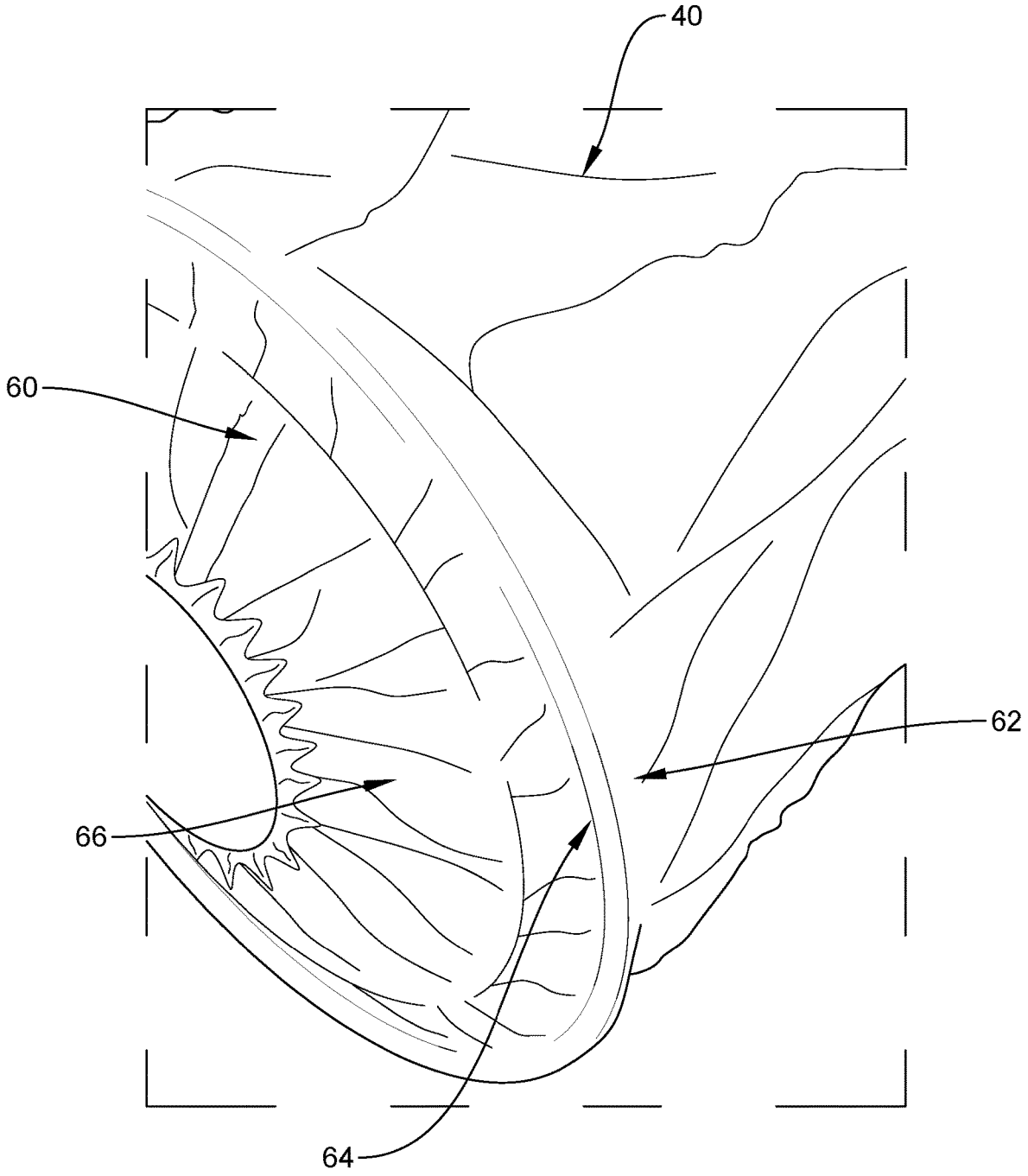
FIG. 11 is a schematic representation of an exemplary attachment means for an exemplary portable containment device.
Figure 12:
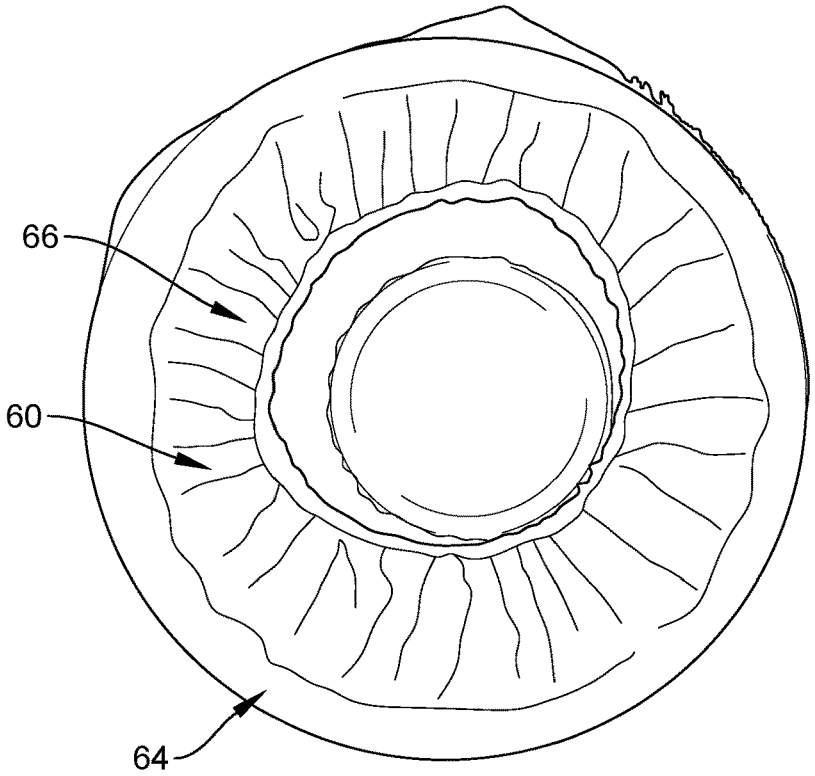
FIG. 12 is a bottom view of an exemplary portable containment device.

Referring now to FIGS. 10 and 11, an exemplary second end 60 of an exemplary portable containment device 10 is shown. In some exemplary embodiments, the second end 60 comprises an end cap 66 that is configured to accommodate a filter 70 that is seated thereon. In other exemplary embodiments, the end cap 66 can comprise the same pliable sleeve 42 that forms the vertical wall 40. In such exemplary embodiments, the end cap 66 is formed by wrapping the pliable sleeve 42 around a circumferential lip 76 (FIG. 10-11, 13) of the filter 70, and then securing the lip 76 in place via an upper attachment means 62 (FIGS. 10-11) and a lower attachment means 64. In this respect, the pliable sleeve 42 can be wrapped around circumferential lip 76 to form an end cap 66 from the same bill of material that is used to form the vertical wall 40. Referring to FIG. 11, an exemplary lower and upper attachment means 62 and 64 can comprise stitching. However, it is also contemplated that any such attachment means described herein (e.g., fastener, adhesive, fusion, clip, hook and loop, heat welding, other heating, ultrasonic welding, chemical (e.g., solvent-based) welding, snaps, staples etc.) can also be utilized.

In yet another exemplary embodiment, a separate end cap 66 can be preformed (not shown) to include a filter 70 such that the end cap 66 can be selectively removable (e.g., via hook and loop, clip, clasps, etc.) from the chamber vertical wall 40 (e.g., as a replaceable component).

Figure 13:
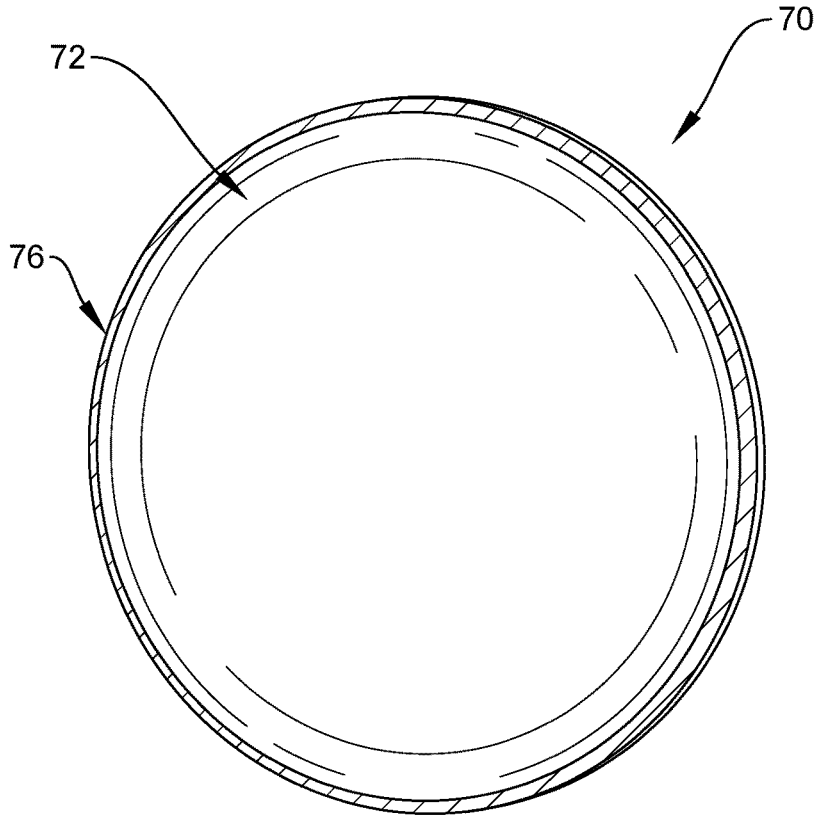
FIG. 13 shows an exemplary filter for an exemplary portable containment device.
Figure 14:
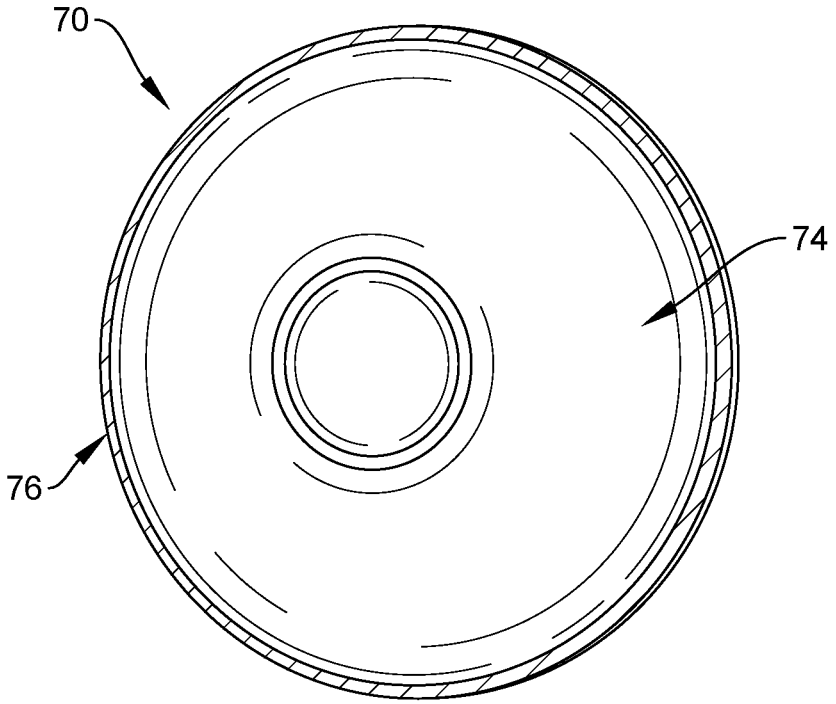
FIG. 14 is a bottom view of the exemplary filter according to FIG. 13.

Referring now to FIGS. 13 and 14, an exemplary filter 70 is shown. Exemplary filter 70 can comprise a planar disk that has an outer diameter that is devised to be slightly smaller than the internal diameter of the chamber vertical wall 40. In this respect, the filter 70 can be in inserted into the chamber 12, and then later secured by the attachment means 62 and 64 described above. The filter 70 can comprise an outer surface 72 and an inner surface 74 opposite the inner outer surface 72. In some exemplary embodiments, the filter 70 can be capable of filtering 95% of airborne particulates or pathogens passing through the filter 70 (e.g., a NIOSH N95 or P95 rating). In additional exemplary embodiments, the filter 70 is treated with a germicide that is intended to extinguish (or at least help extinguish) germs or harmful microorganisms. However, it is appreciated that other configurations of filter designs can also be utilized (e.g., P100 rating, etc.).

Figure 15:
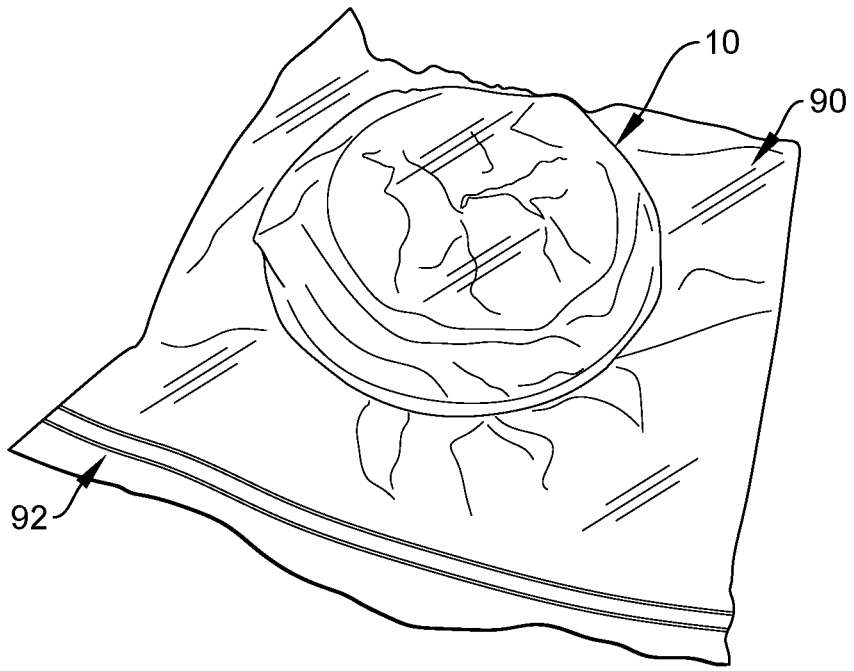
FIG. 15 is a schematic representation of an exemplary container that is configured to store an exemplary portable containment device.

Referring now to FIG. 15, an exemplary container 90 that is configured to accommodate the portable containment device 10 is shown. In some exemplary embodiments, exemplary container 90 can comprise a resealable bag having a pressure sensitive seal 92 or slide-seal structure, respectively, so that any airborne particles that exist therein cannot exit the container 90. In other exemplary embodiments, the container can comprise an envelope-type structure (not shown), like a mailing envelope, e.g., made of paper of coated paper. Exemplary container 90 can also be configured for other purposes. In some exemplary embodiments, an exemplary container 90 can serve as: (1) a point of sale packaging container, (2) a product storage container, (3) a product disposal container, (4) printed usage instructions printed thereon, (5) temporary storage of a used portable containment device (exemplary embodiments of the portable containment device are intended to be low enough in cost to be disposed after each use, but also durable enough to be re-used over a period of time, e.g., a day, 2-3 days, etc.), and/or (6) any such combination described herein. In this respect, contemplating one bill of material can reduce the total cost of the portable containment device 10.

In yet another exemplary embodiment, an opening 22 (FIG. 2) of the portable containment device 10 can include a resealable flap (not shown) that can be secured to a periphery of the opening 22 via an attachment means (e.g., via hook and loop structure, a slide-seal closure structure, pressure sensitive seal, etc.). In this respect, the portable containment device 10 can be self-contained.

In additional exemplary embodiments, an exemplary portable containment device 10 can be made available in a container 90 (FIG. 15) that further includes operating instructions (not shown) listing any of the various methods presented herein. In some exemplary embodiments, operating instructions can be provided on the portable containment device 10 (e.g., via printing, pressure sensitive label, etc.).

Referring now to FIGS. 2-3 and 15-16, an exemplary operating procedure will now be described. To operate the portable containment device 10, a user can remove the portable containment device 10 from the container 90 (FIG. 15) and then pull the first end 20 away from the second end 60 to expand the chamber 60 such that it is at least partially extended (FIG. 3). Then, a user can place their hand underneath the ring 30 that is disposed in the vertical wall 40 (or sleeve 42) of the chamber 12 and place their mouth and chin in the opening 22 such that the chin and mouth are fully confined by a periphery of the opening 22 (FIG. 16). Next, the user can emit or cough airborne particles into the chamber 12. Then, a user can compress the first end 20 towards the second end 60 such that the chamber 12 is collapsed back to a shape and size (see e.g., FIG. 2) making it possible to insert the portable containment device 10 into the container 90. Next, and in some exemplary embodiments, the container 90 can be sealed along a seal structure 92, such as that which is shown in FIG. 15. In some exemplary procedures, the container 90 housing the used portable containment device 10 can then be disposed in a suitable trash receptacle. In other exemplary procedures, the container 90 housing the used portable containment device 10 can then be stowed, permitting the user to re-use the used portable containment device 10.

As described herein, when one or more components are described as being connected, joined, affixed, coupled, attached, or otherwise interconnected, such interconnection may be direct as between the components or may be indirect such as through the use of one or more intermediary components. Also, as described herein, reference to a "member," "component," or "portion" shall not be limited to a single structural member, component, or element but can include an assembly of components, members or elements.

While the present invention has been illustrated by the description of embodiments thereof, and while the embodiments have been described in considerable detail, it is not the intention of the applicants to restrict or in any way limit the scope of the invention to such details. Additional advantages and modifications will readily appear to those skilled in the art. For example, although the examples described herein are directed toward a portable containment device that can be used and disposed of, the teachings herein can also apply equally to a device that is intended for permanent use such that the device can be cleaned and disinfected. Additionally, the filter medium can be removable instead of being permanently secured to the sleeve, as shown in some of the embodiments (e.g., when stitched together). Therefore, the inventive concept, in its broader aspects, is not limited to the specific details, the representative apparatus, and illustrative examples shown and described. Accordingly, departures may be made from such details without departing from the spirit or scope of the applicant's general inventive concept.

What is claimed is:

1. A portable containment device for isolating airborne particles, comprising:

a solid frame defining an opening sized to cover at least a human mouth without covering the eyes;

a pliable sleeve comprising a side wall, a first end secured to the frame, and a second end, the pliable sleeve forming an expandable chamber between the first end and the second end; and a filter arranged at the second end of the pliable sleeve, the filter being operable to entrap airborne particles entering the opening;

wherein the second end of the pliable sleeve is moveable along an axis normal to the opening between a first position and a second position;

wherein the second end is a first distance from the opening in the first position and a second distance from the opening in the second position, the second distance being greater than the first distance;

wherein the chamber is configured to have a compressed configuration when the second end is in the first position and an expanded configuration when the second end is in the second position, and wherein the pliable sleeve is wrapped around the frame such that the pliable sleeve is disposed around the frame with adjacent portions of the pliable sleeve attached together.

2. The portable containment device according to claim 1, wherein the frame is ring-shaped.

3. The portable containment device according to claim 1, wherein the second end further comprises an end cap, the end cap being configured to accommodate the filter that is seated thereon; and a fastener that secures the filter to the portable containment device.

4. The portable containment device according to claim 3, wherein the filter is stitched to the side wall and the end cap.

5. The portable containment device according to claim 3, wherein the end cap comprises pliable material.

6. The portable containment device according to claim 3, wherein the end cap comprises microporous material that is configured to prevent airborne particles from exiting therefrom.

7. The portable containment device according to claim 1, wherein the frame comprises a plurality of reinforcing ribs.

8. The portable containment device according to claim 1, wherein a proximal end of the pliable sleeve is curled around the frame.

9. The portable containment device according to claim 1, wherein a proximal end of the pliable sleeve is curled into a cuff; and wherein the cuff is stitched to the adjacent portion of the pliable sleeve.

10. The portable containment device according to claim 1, wherein the frame comprises plastic injection molded material.

11. The portable containment device according to claim 1, wherein the side wall comprises microporous material that is configured to prevent airborne particles from exiting therefrom.

12. The portable containment device according to claim 1, wherein the portable containment device is provided in a container.

13. The portable containment device according to claim 12, wherein the container is configured to store the portable containment device when disposing the portable containment device.

14. A kit, comprising:

a portable containment device according to claim 1 provided inside a container; and instructions inside, on, or with the container.

15. The kit of claim 14, wherein the instructions instruct a user to:

remove the portable containment device from the container;

extend the portable containment device such that it is at least partially extended;

arrange at least the mouth and a chin in the opening formed in the portable containment device such that the mouth and the chin are confined by a periphery of the opening;

emit airborne particles into the portable containment device as needed; and compress the portable containment device such that it returns to a storable position;

place the portable containment device into the container after each use;

reseal the container; and dispose of the container.

16. A method for preventing transmission of airborne particles, comprising:

providing a resealable container;

providing a portable containment device having a ring-shaped frame defining an opening, a tubular, pliable sleeve forming an expandable chamber, and a filter disposed in the expandable chamber, wherein the sleeve includes a vertical wall, a first end, and a second end, wherein the opening is configured to receive at least a human mouth and a chin, wherein the opening, the vertical wall, and the filter define the expandable chamber, and wherein the pliable sleeve is wrapped around the frame such that the pliable sleeve is disposed around the frame with adjacent portions of the pliable sleeve attached together;

expanding the expandable chamber by moving the filter longitudinally away from the opening such that the expandable chamber is at least partially extended in an expanded configuration in which a distance between the filter and the opening is larger than the container;

arranging at least the mouth and the chin in the opening such that the mouth and the chin are fully confined by a periphery of the opening;

emitting airborne particles into the portable containment device, wherein the filter is configured to remove at least 95% of the particles that are at least 0.3 microns in diameter; and compressing the second end toward the first end such that the portable containment device returns to a compressed configuration smaller than the container.

17. The method according to claim 16, further comprising the steps of placing the portable containment device into the container, sealing the container, and then disposing the container.

18. A portable containment device for isolating airborne particles, comprising:

a tubular, pliable sleeve, wherein the sleeve includes an upper end, a circumferential side wall, and a lower wall;

an opening formed at the upper end, wherein the opening is defined by a plastic ring that is disposed in the upper end and secured via stitching;

wherein the sleeve further comprises microporous, polypropylene-based material;

wherein a disk-shaped particulate filter is arranged in a lower-most portion of the sleeve;

wherein the filter is secured to a periphery of the circumferential side wall and the lower wall via stitching, wherein the filter is operable to entrap airborne particles entering the portable containment device;

wherein the sleeve is configured to be expandable when operating the portable containment device, and collapsible when storing the portable containment device;

wherein the filter is longitudinally moveable from a first distance from the opening when the sleeve is collapsed to a second distance from the opening when the sleeve is expanded, the first distance being less than the second distance;

wherein the particulate filter is configured to remove at least 95% of particles that are at least 0.3 microns in diameter.

19. The portable containment device according to claim 18, wherein the opening is sized to cover a human mouth and a chin, without also covering the nostrils or nose.

20. The portable containment device according to claim 18, wherein the opening is sized to cover a mouth, nostrils, and chin.

* * * * *